United States Patent [19]

Burket et al.

[11] 4,443,504

[45] Apr. 17, 1984

[54] COATING METHOD

[75] Inventors: Richard S. Burket, Brevard; Brian F. Conaghan; Robert I. Hirshburg, both of Hendersonville, all of N.C.

[73] Assignee: E. I. Du Pont de Nemours & Company, Wilmington, Del.

[21] Appl. No.: 386,679

[22] Filed: Jun. 9, 1982

[51] Int. Cl.[3] ..... B05C 5/02

[52] U.S. Cl. ..... 427/445; 118/407; 118/412; 427/402

[58] Field of Search ..... 118/407, 411, 412; 427/445, 402

[56] References Cited

U.S. PATENT DOCUMENTS

| | | | |
|---|---|---|---|
| 2,761,417 | 9/1956 | Russell et al. | 118/410 |
| 2,761,418 | 9/1956 | Russell | 118/410 |
| 2,761,419 | 9/1956 | Mercier et al. . | |
| 3,289,632 | 12/1966 | Barstow | 118/412 |
| 3,928,678 | 12/1975 | Jackson | 427/402 |
| 3,958,532 | 5/1976 | Timson | 118/325 |
| 4,241,689 | 12/1980 | Kobayashi et al. | 118/50 |
| 4,283,443 | 8/1981 | Choinski | 427/295 |

FOREIGN PATENT DOCUMENTS

| | | |
|---|---|---|
| 1932905 | 1/1971 | Fed. Rep. of Germany . |
| 2299921 | 3/1976 | France . |
| 1268144 | 3/1972 | United Kingdom . |

*Primary Examiner*—John P. McIntosh

[57] ABSTRACT

A slide coating apparatus wherein the angle between the slide surface and a horizontal datum plane lies within a range from 35° to 50° and wherein the takeoff angle defined between a tangent to the coating roll and the slide surface lies within a range from 85° to 100°.

4 Claims, 3 Drawing Figures

COATING METHOD

BACKGROUND OF THE INVENTION

This invention relates to slide coating apparatus and in particular to a slide coating apparatus wherein the slide surface angle and takeoff angle lie within predetermined limits.

A conventional multi-slide coating apparatus, as disclosed in U.S. Pat. No. 2,761,417 (Russell et al.), performs coating operations by metering individual layers of a coating fluid from a supply, through a trough disposed inside the hopper and then through a narrow distribution slot. A coating fluid is distributed by the slot as a layer uniformly across a downwardly inclined slide surface. Such layer of coating fluid flows by gravity down the slide surface and meets with the adjacent underlayers of coating fluid which have been similarly metered and distributed through narrow slots. The combined coating fluid layers then flow down the slide surface and form a coating bead. The web to be coated is carried by a backup roll and is moved across the bead. The fluid layers in the bead impinge upon the moving web which picks up the multilayer coating fluids from the slide surface.

A cascade coater is a slide coating apparatus in which the impingement point between the multilayer coating fluids and the web is located above the horizontal center line of the backup roll supporting the web to be coated. Exemplary of such a device is that shown in U.S. Pat. No. 3,289,632 (Barstow). British Patent Specification 1,268,144 discusses the desirability of having the slide surface of a cascade coater define an angle of less than 30° with respect to a predetermined horizontal datum.

It has been observed that defects in coating quality are related to the magnitude of a takeoff angle defined between the slide surface and a tangent erected at the point of impingement of the coating fluid onto the backup roll. In an effort to overcome such defects U.S. Pat. No. 4,283,443 (Choinski) discloses a cascade coater having a slide surface with a lip disposed at the lowermost end thereof which lip changes the direction of flow of the fluid layers to a generally upwardly direction aligned with the upward direction of the web movement.

In a slide coating apparatus one or more fluids to be coated on a moving web are accelerated toward the moving web by gravity. Due to the inclination of the slide surface with respect to a horizontal datum the gravitational force imposed on the coating fluid is resolvable into two components, one parallel to the slide surface and the second perpendicular thereto. The momentum of the coating fluid as it impinges upon the moving web is related to the component of the gravitational force parallel to the slide surface. It is desirable that the momentum of the coating fluid be as high as possible in order to overcome the forces which oppose the deposition of the coating fluid onto the web. These opposition forces include forces due to the surface tension of the coating fluid, high shear forces due to the velocity of the web, and forces due to air drawn along the surface of the web under the bead of coating fluid.

The perpendicular component of the gravitational force acting on the coating fluid as it moves down the slide surface tends to even the distribution of the fluid across the transverse dimension of the slide, an effect known in the art as "leveling". In addition, the component of force perpendicular to the slide surface tends to maintain the transverse dimension of the coating fluid and prevents a shrinkage or "neck in" of the transverse dimension of the coating fluid at a given point. In order to maximize the leveling effect it is desirable that the component of the accelerating force perpendicular to the slide surface be as large as possible. However, increasing the perpendicular component has the necessary consequence of decreasing the parallel component thus decreasing the momentum, and vice versa.

Accordingly, it would be desirable to provide a slide surface coating apparatus wherein the component of accelerating force perpendicular to the slide surface and the component parallel thereto are both optimized so that the maximum impingement momentum is achieved while still maintaining an adequate leveling force.

SUMMARY OF THE INVENTION

This invention relates to a slide surface coating apparatus along which a coating fluid flows by gravity toward an impingement point on a moving web carried by a coating roll, the slide surface defining an angle with respect to a horizontal datum plane, wherein the angle between the slide surface and the datum plane lies in a range from 35° to 50° and the impingement point of the coating fluid with the web is disposed above the horizontal center line of the coating roll such that a tangent to the coating roll at that point defines a takeoff angle with respect to the slide surface which takeoff angle lies in the range from 85° to 100°. In the preferred embodiment the slide surface angle is 40° and the takeoff angle is 90°.

BRIEF DESCRIPTION OF THE DRAWINGS

The invention will be more fully understood from the following detailed description thereof taken in connection with the accompanying drawings which form a part of this application and in which.

DETAILED DESCRIPTION OF THE INVENTION

Figure 1:
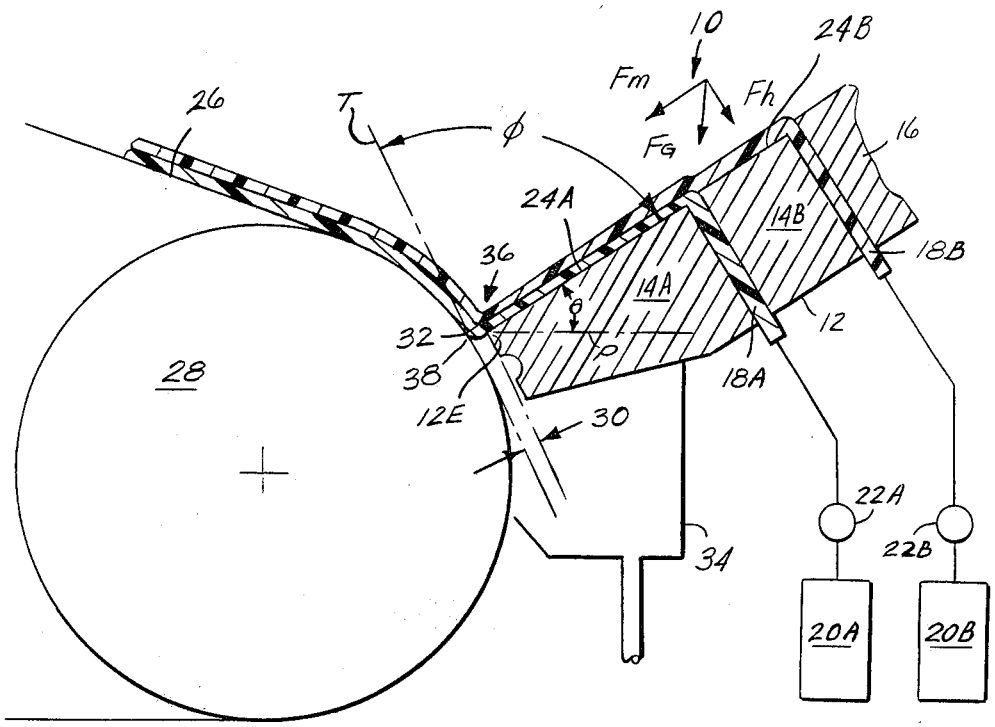
FIG. 1 is a highly stylized schematic representation of a side elevational view of a slide coating apparatus in accordance with the instant invention.

Throughout the following detailed description similar reference numerals refer to similar elements in all figures of the drawings.

Referring to FIG. 1 shown is a highly stylized schematic side elevational view of a slide coating apparatus generally indicated by reference character 10 in accordance with the teachings of the instant invention. The slide coating apparatus includes a coating head 12 formed of a plurality of distribution headers 14A and 14B joined together by a suitable biasing arrangement 16. It is to be understood that any predetermined number of distribution headers 14 may be disposed within the coating head 12 and remain within the contemplation of the instant invention.

Each distribution header includes a metering slot 18 disposed in fluid communication with a reservoir 20 of coating fluid. Coating fluid from each of the reservoirs 20 is metered into the distribution slots 18 by a pump 22.

As the coating fluid wells from the mouth of each distribution slot 18 it is accelerated by gravity along an inclined slide surface 24 toward a web 26 carried by a backup roll 28. Each of the slide surfaces 24A and 24B are parallel to each other. In practice, the plane containing the slide surface 24B lies parallel to and slightly above the plane containing the slide surface 24A. The lower edge 12E of the distributing head 12 lies within a predetermined close gap 30 from the surface of the web 26. Suitable edge guides (not shown) may be provided along the lateral edges of the surface 24 if desired.

As the coating fluid bridges the gap 30 a bead 32 of coating fluid is formed. A vacuum box 34 is disposed upstream of the bead 32. The vacuum box 34 withdraws air from that region beneath the bead 32 thus creating a low pressure region. The pressure differential between the region beneath the bead 32 and above the coating fluid generates a force acting in the direction 36 tending to push the bead against the web 26. The point 38 at which the bead 32 contacts the web 26 is known as the impingement point. The impingement point 38 lies near to the intersection of a line extending from the inclined surface 24A and the surface of the roll 28. Of course, the exact location of the impingement point 38 is dependent upon the vacuum in the vacuum box 34, the speed of the web 26 and the flow of the fluids down the slide surface.

In accordance with this invention each slide surface 24 defines a predetermined angle Theta with respect to a horizontal datum plane P, which angle Theta lies in a range from 35° to 50°. In addition, the slide surfaces 24A and 24B define a second predetermined angle Phi with respect to a reference line T erected as a tangent to the backup roll 28 at the impingement point 38. The angle Phi lies within the range from 85° to 100°. Preferably the angle Theta is 40° and the angle Phi is 90°.

As a coating fluid emanates from its distribution slots 18 onto the slide surface 24 it is subjected to a gravitational force $F_g$. The gravitational force $F_g$ may be resolved into a first component $F_m$ extending parallel to the surface 24 and a second component $F_h$ extending perpendicularly thereto. The force $F_m$ accelerates the coating fluid along the inclined slide surface 24 toward the impingement point 38. The magnitude of the momentum of the coating fluid toward the impingement point 38 is functionally related to the magnitude of the force $F_m$.

The force component $F_h$ tends to distribute the coating fluid evenly across the transverse dimension of the distribution head 12 and opposes any force which would tend to "neck in" the coating fluid at any point as it flows down the slide surface 24.

Figure 2:
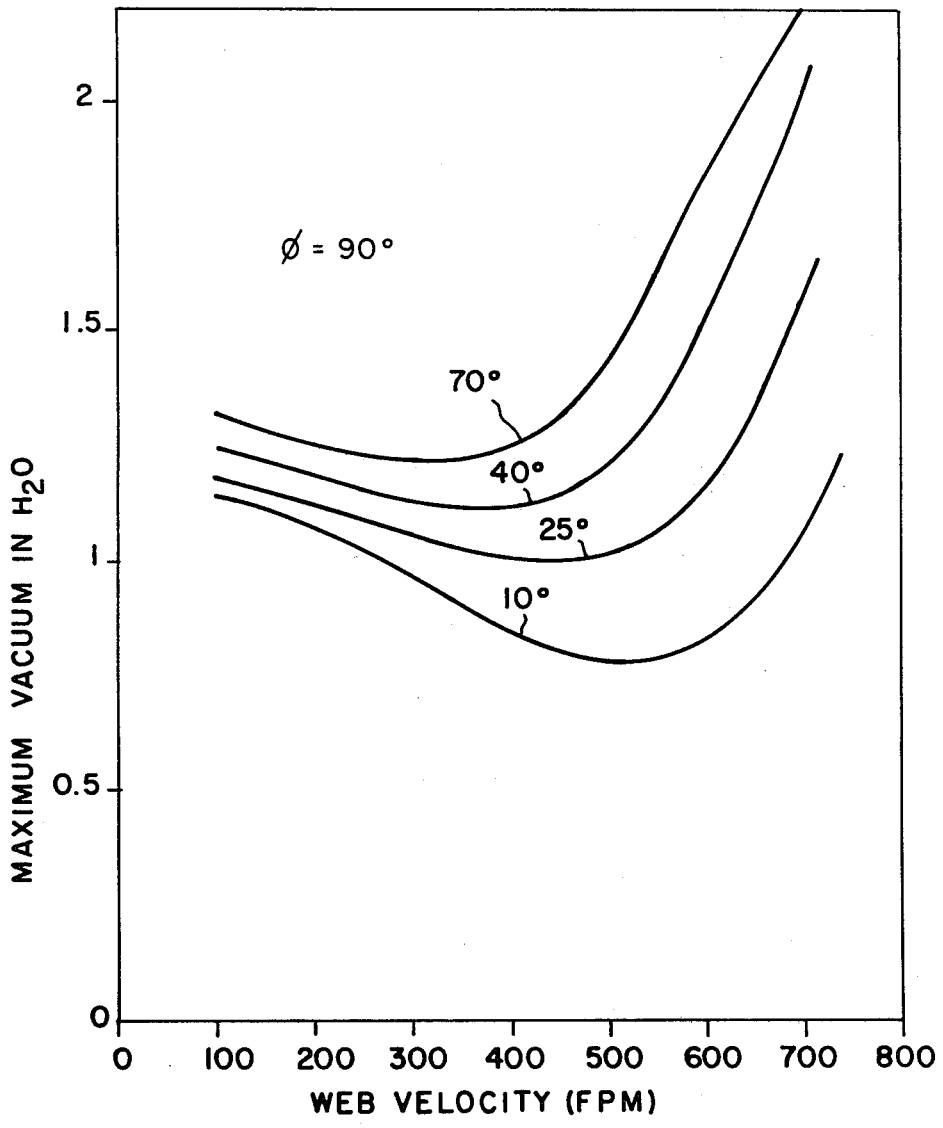
FIGS. 2 and 3 are graphical representations illustrating the relationship between a force (vacuum) required to destabilize the coating fluid bead as a function of various coating speeds (web velocity) at various slide angles and at various takeoff angles, respectively.
Figure 3:
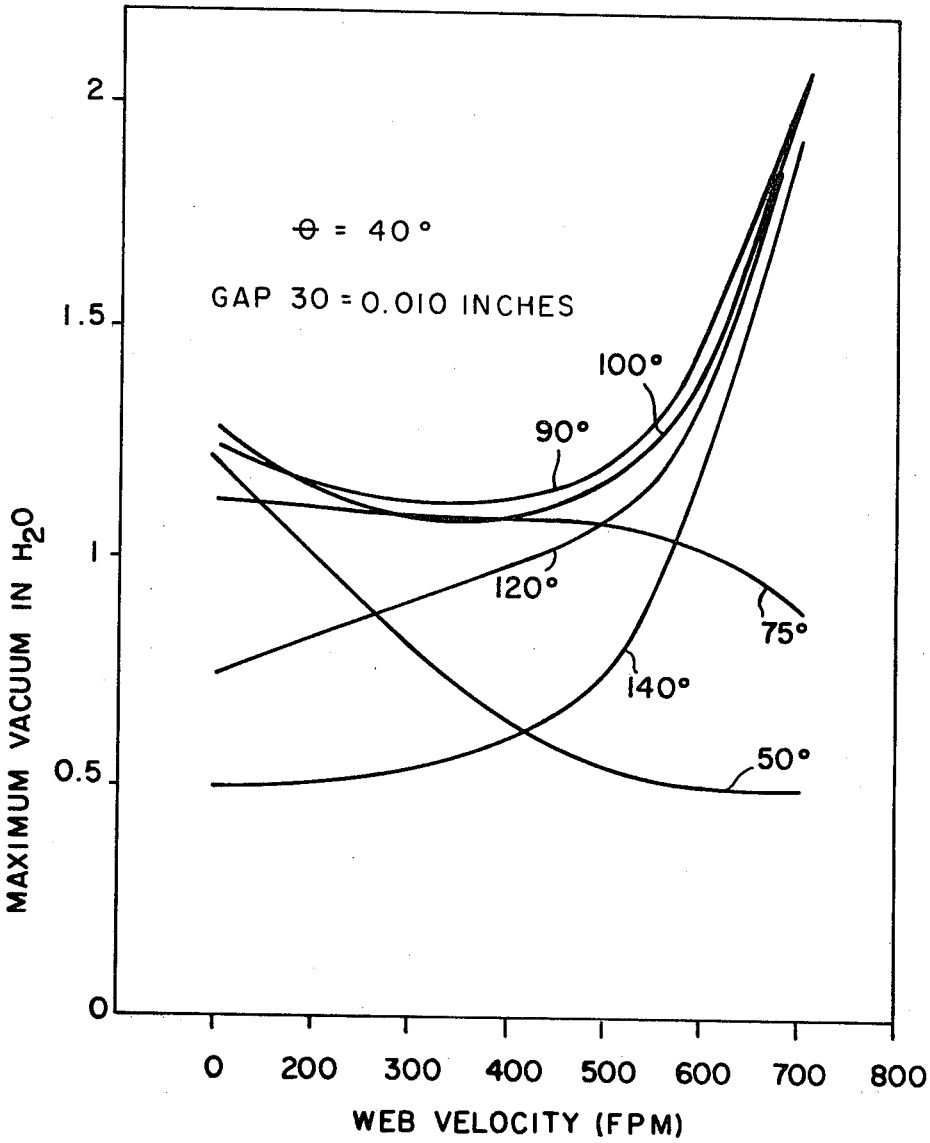

With reference to FIGS. 2 and 3 shown are graphical representations of the force necessary to destabilize the bead 32 (measured as a function of the vacuum drawn by the vacuum box 34) plotted against various coating speeds (in feet per minute of the web 26) for each of a predetermined number of angles Theta for a predetermined coating thickness on the web 26 (FIG. 2) and for a predetermined number of angles Phi (FIG. 3). From FIG. 2 it is observed that at any constant web speed as the angle Theta increases the vacuum force required to destabilize the bead 32 increases. Not apparent from FIG. 2 is the fact that the leveling effect is less pronounced as the angle Theta is increased. Visual observations indicated that while the vacuum needed to destabilize the bead increases with increased angle Theta, when the angle Theta exceeds 50° defects due to inadequate leveling render the coating quality unacceptable.

From FIG. 3 it may be observed that optimum bead stability at all coating speeds is obtained when the angle Phi lies in the range from 85° to 100°, with 90° being preferred. Thus in accordance with the invention if the slide surface angle Theta lies within a range from 35° to 50° and the takeoff angle Phi lies within a range from 85° to 100° the magnitude of the momentum force $F_m$ is maximized while simultaneously the magnitude of the leveling force $F_h$ is adequate to maintain the coating fluid against the surface 24 and promote leveling of defects. In the preferred embodiment of the invention the takeoff angle Phi is 90°. Thus, the momentum of the coating fluid onto the web 26 is a maximum.

While those skilled in the art having benefits of the teaching of the instant invention as hereinabove set forth may effect numerous modifications thereto, such modifications are to be construed as lying within the scope of the instant invention as defined by the appended claims.

What is claimed is:

1. A method of coating a moving web carried by a coating roll using a slide surface along which a coating fluid flows by gravity toward an impingement point on the web, the slide surface defining an angle with respect to a horizontal datum plane, comprising the steps of:

(a) adjusting the angle between the slide and the datum plane to a predetermined angle in a range from 35° to 50°;

(b) locating the coating fluid impingement point above the center line of the coating roll such that a tangent to the coating roll at the impingement point defines a takeoff angle with respect to the slide surface at a predetermined angle in the range from 85° to 100°; and (c) introducing a coating fluid onto the slide.

2. The method of claim 1 wherein the slide surface angle is 40°.

3. The method of claim 2 wherein the takeoff angle is 90°.

4. The method of claim 1 wherein the takeoff angle is 90°.

* * * * *